US005907956A

United States Patent [19]

Arima et al.

[11] Patent Number: 5,907,956

[45] Date of Patent: Jun. 1, 1999

[54] AIR CONDITIONING SYSTEM

[75] Inventors: Hidetoshi Arima; Kazuhiro Shimura; Naohito Sakamoto; Mamoru Kubo; Akira Hatakeyama, all of Gunma-ken, Japan

[73] Assignee: Sanyo Electric Co., Ltd., Osaka, Japan

[21] Appl. No.: 08/961,311

[22] Filed: Oct. 30, 1997

[30] Foreign Application Priority Data

Oct. 31, 1996 [JP] Japan ..... 8-290171
Jun. 17, 1997 [JP] Japan ..... 9-159941

[51] Int. Cl.[6] ..... F24F 5/00

[52] U.S. Cl. ..... 62/148; 62/201; 62/159; 165/104.21

[58] Field of Search ..... 62/227, 201, 185, 62/430, 434, 436, 148, 146, 159, 119; 165/104.21, 104.22, 104.25

[56] References Cited

U.S. PATENT DOCUMENTS

| | | | |
|---|---|---|---|
| 4,429,541 | 2/1984 | Kamejima et al. | 62/201 |
| 4,843,832 | 7/1989 | Yamada et al. | 165/104.21 |
| 4,894,998 | 1/1990 | Kaneko et al. | 62/148 |
| 5,138,846 | 8/1992 | Ogawa et al. | 62/148 |
| 5,607,013 | 3/1997 | Inoue et al. | 165/104.21 |

*Primary Examiner*—Harry B. Tanner

*Attorney, Agent, or Firm*—Weingarten, Schurgin, Gagnebin & Hayes LLP

[57] ABSTRACT

In an air conditioning system comprising a heat source side machine for condensing a fluid which can change a phase between a liquid phase and a gas phase to a predetermined temperature and for supplying, and a plurality of user side machines more than half of which are disposed below said heat source side machine, in which piping is constructed in such a manner as to circulate the fluid supplied from said heat source side machine by using a difference in specific gravity between the liquid phase and the gas phase, between said heat source side machine and said user side machine and a cooling of said user side machine is performed by evaporating said fluid in said user side machine, the heat source side machine is provided with a control means for descending a set temperature of said fluid discharged from said heat source side machine after condensed by changing the operating capacity of said heat source side machine when a state that the temperature of said fluid returned back after evaporated in the user side machine at a time of a cooling is higher than a predetermined temperature continues for a predetermined time period. Accordingly, even when the cooling effect is insufficient due to the super-heated state of the fluid in the user side machine, the super-heated state of the fluid is resolved after the predetermined time has passed, thereby returning to the normal cooling

5 Claims, 7 Drawing Sheets

AIR CONDITIONING SYSTEM

BACKGROUND OF THE INVENTION

1. Field of the Invention

The present invention relates to an air conditioning system, and more particularly to a system for circulating a fluid which can change a phase between a gas phase and a liquid phase by a difference of a specific gravity between a gas phase and a liquid phase between a heat source side machine and a plurality of user side machines disposed below the heat source side machine, so that each of the user side machines can at least perform a cooling operation.

2. Background Art

Conventional arts include, for example, a system as shown in FIG. 7 as an air conditioning system which does not need a power for transporting a phase-changeable fluid, that is, a fluid changing a phase between a liquid phase and a gas phase by outputting or inputting a latent heat. In this system, a heat source side machine 1 serving as a condenser is mounted at a high position of a building, and a liquid phase pipe 6 and a gas phase pipe 7 connect the heat source side machine with a heat exchanger 5 of an user side machine 4 mounted in a room to be air-conditioned disposed in a lower position than the heat source side machine. The system supplies a liquid which is heat-discharged and condensed by the heat source side machine 1 to the heat exchanger 5 of the user side machine 4 through the liquid phase pipe 6 by its own weight and on the contrary returns a gas which is heat-absorbed and evaporated by heat-exchanging with a warm air in the room by the heat exchanger 5 of the user side machine 4 to the heat source side machine 1 of which pressure becomes lower by condensing of the liquid through the gas phase pipe 7, thereby capable of performing a circulation. Accordingly, there are advantages such that a transporting power such as a electric pump is not necessary and a running cost can be reduced. In this case, reference numeral 8 denotes a flow control valve and reference numeral 9 denotes a blower.

In the heat source side machine 1, the operation capacity of the heat source side machine 1 is controlled in such a manner that the temperature of the fluid discharged from the heat source side machine after condensed to the liquid phase pipe 6 is kept constant. In each of the user side machines 4, the opening ratio of the fluid control valve 8 is controlled in such a manner that the fluid supplied from the heat source side machine 1 through the liquid phase pipe 6 at a constant temperature is discharged to the gas phase pipe 7 at a predetermined temperature after being heat-exchanged with the air within the room supplied by the blower 9.

However, in the air conditioning system having the above structure, since only the weight of the fluid which discharges the heat in the heat source side machine, is condensed and is stored in the liquid phase pipe acts as a power for supplying the fluid to the user side machine, the amount of the fluid which can flow into the user side machine is limited and the fluid is super-heated in the case of large cooling load, so that the cooling performance tends to be insufficient.

Further, when the operating number of the user side machines is changed, or the temperature difference of the fluid flowing into or discharging out of the user side machine is changed due to the change of the air conditioning load within the room, or the opening ratio of the flow control valve is changed, the operating performance of the heat source side machine is not changed immediately, but as in the same manner as the conventional manner in which the forcible circulation is performed, after recognizing the actual temperature change of the fluid discharged from the heat source side machine to the liquid phase pipe, the operating performance of the heat source side machine is controlled in such a manner that the temperature returns to a predetermined temperature. Accordingly, there is a problem that the air conditioning system is delay in replying the change of the air conditioning load. Still further, in the conventional type of air conditioning system for forcibly circulating with an electric pump, there is a problem that a quicker response with respect to the change of the air conditioning load is desired. Accordingly, there is a desire that the above problems should be solved.

SUMMARY OF THE INVENTION

An object of the present invention is to provide an air conditioning system for solving the above problems.

In accordance with the present invention, there is provided an air conditioning system comprising a heat source side machine for condensing a fluid which can change a phase between a liquid phase and a gas phase at a predetermined temperature and for supplying, and a plurality of user side machines more than half of which are disposed below said heat source side machine, in which piping is constructed in such a manner as to circulate the fluid supplied from said heat source side machine by a difference in specific gravity between the liquid phase and the gas phase, between the heat source side machine and the user side machine and a cooling of the user side machine is performed by evaporating the fluid in said user side machine, wherein the heat source side machine is provided with a control means for descending a set temperature of the fluid discharged from the heat source side machine after condensed by changing the operating capacity of the heat source side machine when a state that the temperature of the fluid returned back after evaporated in the user side machine at a time of a cooling is higher than a predetermined temperature continues for a predetermined period of time In accordance with the invention as recited in claim 2, there is provided an air conditioning system comprising a heat source side machine for controlling a fluid which can change a phase between a liquid phase and a gas phase at a predetermined temperature and for supplying, and a plurality of user side machines more than half of which are disposed below the heat source side machine, in which piping is constructed in such a manner as to circulate the fluid supplied from the heat source side machine, between the heat source side machine and the user side machine and a cooling or heating of the user side machine is performed by evaporating or condensing the fluid in the user side machine, wherein the heat source side machine is provided with a control means for adjusting a predetermined temperature of the fluid for a predetermined period of time when a change of an air conditioning load relating value such as a number of the operating user side machines, a total volume of the fluid flowing in the user side machines or a value corresponding to the total volume, and a total of temperature differences of the fluid flowing in the user side machines is over a predetermined value.

In accordance with the invention as recited in claim 3, there is provided an air conditioning system in which in the case that the change of the air conditioning relating value is a change to a direction that the air conditioning load is reduced, the control means ascends the predetermined temperature of the fluid at a time of the cooling and descends the predetermined temperature of the fluid at a time of the heating, and in the case that the change of the air conditioning relating value is a change to a direction that the air conditioning load is increased, the control means descends the predetermined temperature of the fluid at a time of the cooling and ascends the predetermined temperature of said fluid at a time of the heating.

In accordance with the invention as recited in claim 4, there is provided an air conditioning system in which in the case that the change of the air conditioning relating value is a change to a direction that the air conditioning load is increased, the control means further descends the supplying pressure of the fluid at a time of the cooling.

In accordance with the invention as recited in claim 5, there is provided an air conditioning system in which in the case that the change of the air conditioning relating value is a change to a direction that the air conditioning load is increased, the control means descends the supplying pressure of the fluid in place of the predetermined temperature of said fluid at a time of the cooling.

DETAILED DESCRIPTION OF THE PREFERRED EMBODIMENTS

Figure 7:
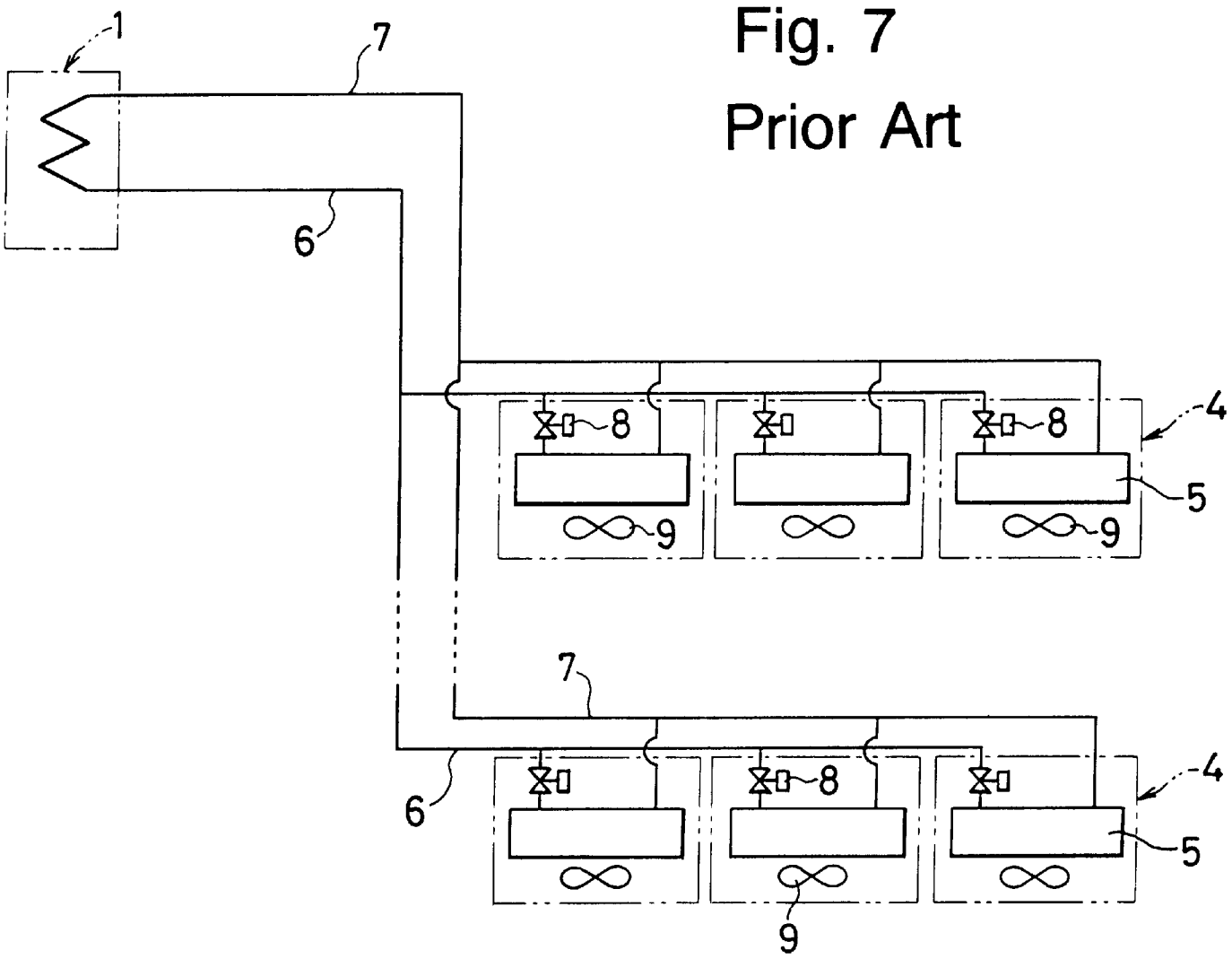
Fig. 7 Prior Art
FIG. 7 is a view which explains a prior art.

An embodiment in accordance with the present invention will be described below with reference to FIGS. 1 to 6. In this case, in order to easily understand the structure, the same reference numerals are attached to the parts having the same functions of the parts explained in FIG. 7.

Figure 1:
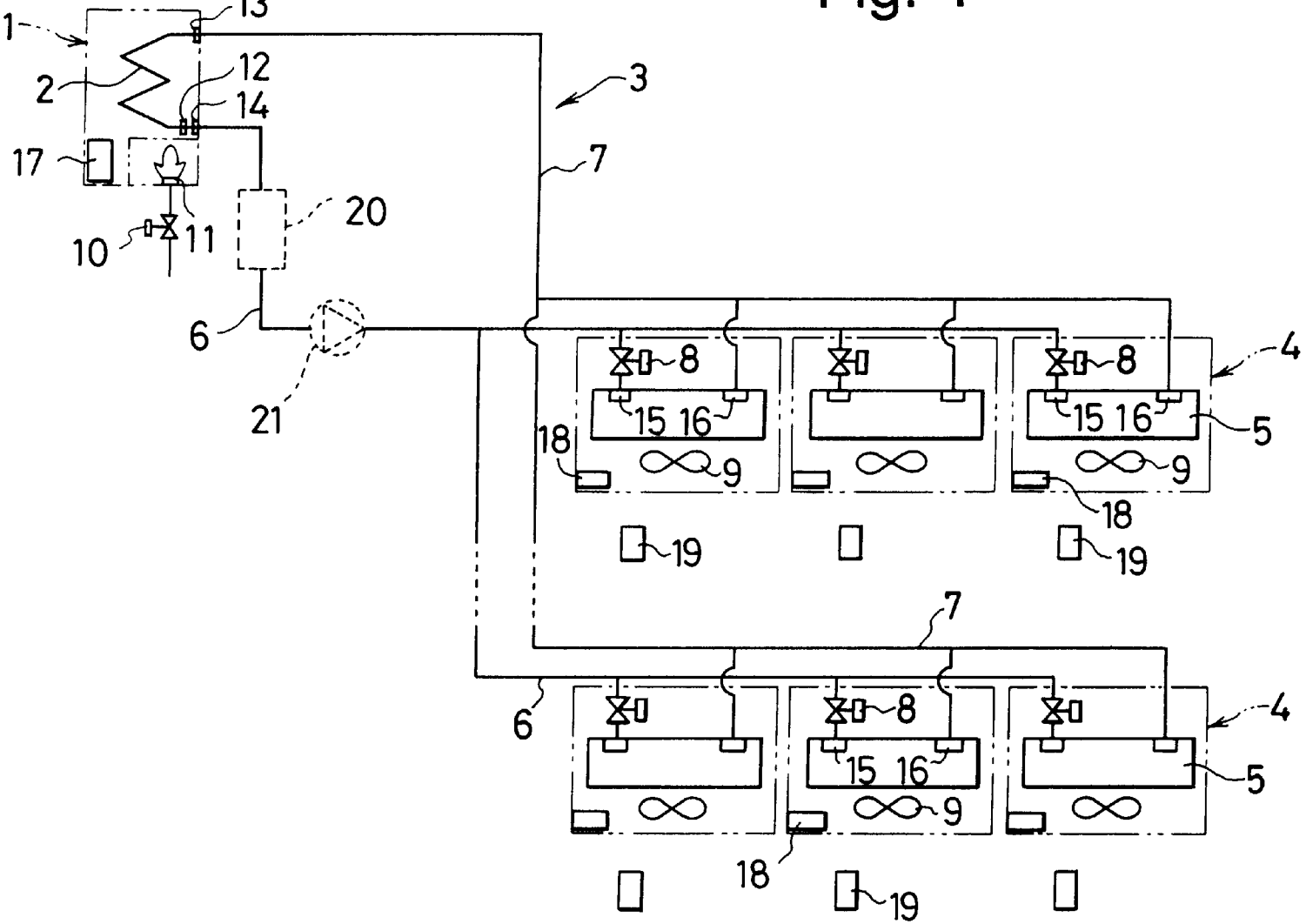
FIG. 1 is a view which explains a structure of an air conditioning system constituted for only performing a cooling.
Figure 2:
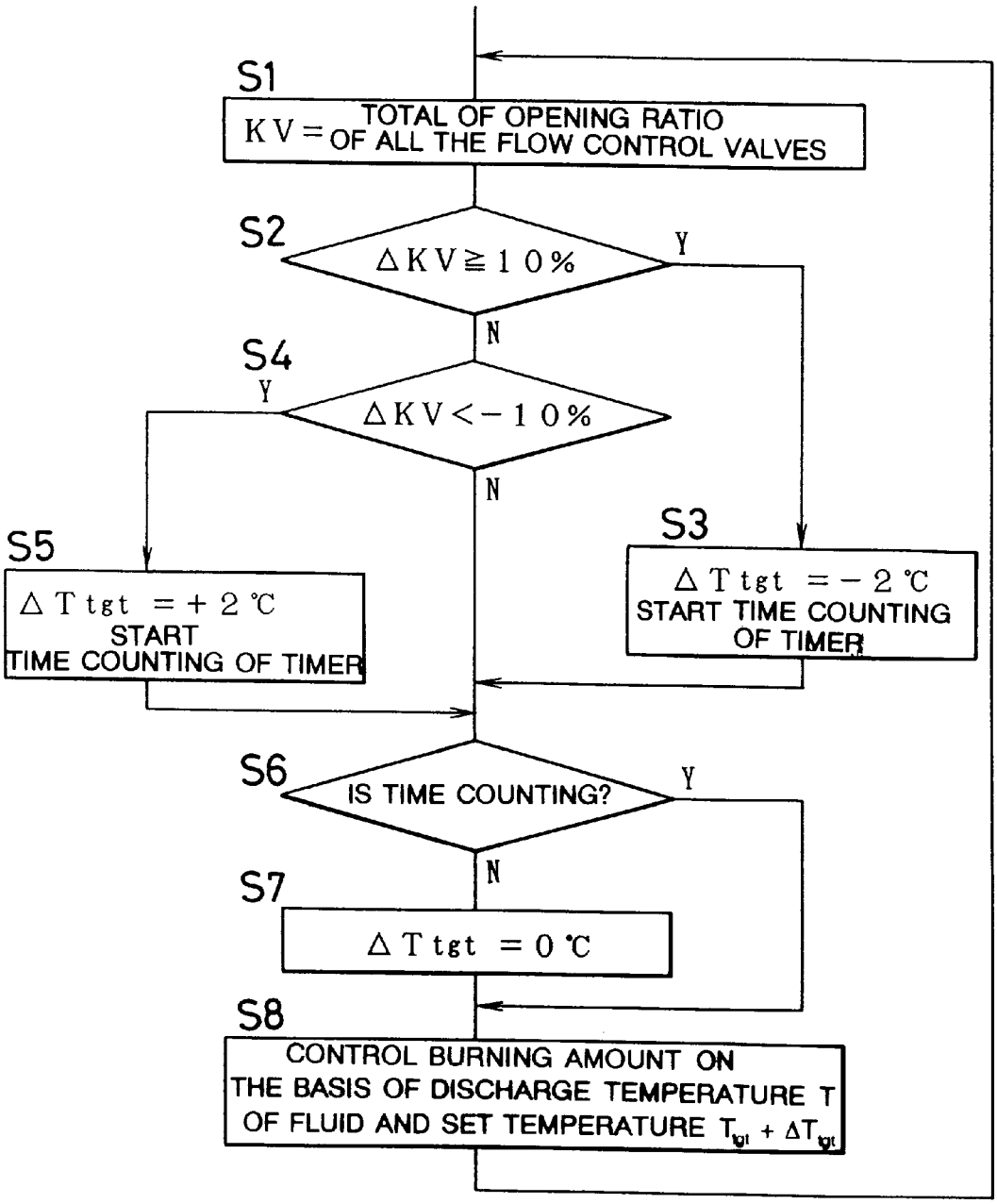
FIG. 2 is a view which explains an embodiment of a control state at a time of performing a cooling.

FIG. 1 shows an embodiment of an air conditioning system in accordance with the present invention, in which reference numeral 1 denotes a user side machine comprising, for example, an absorption type refrigerator (refer to U.S. Pat. No. 5,2240,352), which has a cooling function. The user side machine 1 is mounted in a machine room disposed on, for example, the rooftop of the building and gives and receives a heat by a fluid capable of changing a phase between a gas phase and a liquid phase and sealed in a closed circuit 3, for example, a refrigerant R-134*a* which can easily evaporate even at a low temperature when the pressure is lowered, for example, through a heat exchanger 2 disposed within an evaporator.

Reference numeral 5 denotes a heat exchanger of an user side machine 4 mounted on each of the rooms in the building. The heat source side machine 1 and the heat exchangers 5 of the plurality of the user side machines 4 are connected by a liquid phase pipe 6, a gas phase pipe 7 and flow control valves 8 so as to form the closed circuit 3.

In this case, reference numeral 10 denotes a fuel control valve of a burner 11 for heating an absorption liquid in a regenerator (not shown) and evaporating and separating a gasified refrigerant from the absorption liquid, reference numeral 12 denotes a flow speed sensor for detecting a flow speed of the refrigerant R-134*a* circulating in the closed circuit 3, and reference numerals 13 to 16 denote temperature sensors for detecting a temperature of the refrigerant R-134*a* circulating in the closed circuit 3.

Further, the heat source side machine 1 is provided with a heat source control apparatus 17 and the user side machine 4 is provided with a user control apparatus 18. The heat source control apparatus 17 is provided with a function for controlling the opening ratio of the fuel control valve 10 in such a manner that the temperature of the refrigerant R-134*a* detected by the temperature sensor 14, that is, the temperature of R-134 discharged to the liquid phase pipe 6 after being received the cooling effect in the heat exchanger 2 becomes a predetermined temperature, for example, 7° C. The user control apparatus 18 is provided with a function for controlling the opening ratio of the fuel control valve 8 in such a manner that the temperature of the refrigerant R-134*a* detected by the temperature sensor 16, that is, the temperature of R-134 discharged to the gas phase pipe 7 after performing the cooling through the heat exchanger 5 and increasing the temperature thereof becomes a predetermined temperature, for example, 12° C.

Further, a remote controller 19 which can be communicated with the user control apparatus 18 and perform starting or stopping the cooling, selecting a strength of wind to be blown, and a temperature set is provided in correspondence to each of the user side machines 4.

Then, in the heat source side machine 1, when the opening ratio of the fuel control valve 10 is increased and heating power is increased by increasing the fuel supplied to the burner 11, the amount of the refrigerant evaporated and separated from the absorption liquid (not shown) is increased. Since the increased refrigerant gas discharges the heat in the condenser (not shown) so as to be condensed, it becomes the liquid and is supplied to the periphery of the heat exchanger 2 so as to absorb the heat from the refrigerant R-134*a* flowing within the heat exchanger 2 and thereafter evaporated, thereby the function for cooling the refrigerant R-134*a* flowing within the heat exchanger 2 is strengthened, so that the degree of decreasing the temperature is increased as far as the flow amount is the same. On the contrast with this, when the opening ratio of the fuel control valve 10 is reduced and the heating power of the burner 11 is reduced, the function of cooling the refrigerant R-134*a* flowing within the heat exchanger 2 is weakened, so that the degree of decreasing the temperature is decreased.

On the contrary, in the user side machine 4, when the opening ratio of the flow control valve 8 is the same, the larger the air conditioning load is, the more the temperature difference of the refrigerant R-134*a* detected by the temperature sensors 15 and 16 is enlarged, and the smaller the air conditioning load is, the more the temperature difference is reduced.

Next, a circulating cycle of the refrigerant R-134*a* sealed in the closed circuit 3 will be described below. Since the refrigerant R-134*a* is cooled by the cooling function of the heat source side machine 1 through a pipe wall of the heat exchanger 2, the refrigerant R-134*a* is condensed and discharged to the liquid phase pipe 6 in the downstream, and is supplied to the heat exchanger 5 of each of the user side machines 4 through the flow control valve 8 at a predetermined temperature, for example, 7° C.

On the contrary in each of the user side machines 4, since the warm air in the room is forcibly supplied by the blower 9, the refrigerant R-134*a* supplied from the heat source side machine 1 at a temperature of 7° C. absorbs the heat from the air in the room and evaporated, thereby performing the cooling.

Then, the refrigerant R-134*a* in a gas phase is cooled so as to be condensed and liquefied, so that a natural circulation is generated by flowing into the heat exchanger 2 of the heat source side machine 1 having a low pressure through the gas phase pipe 7.

However, in the circulation of the refrigerant R-134*a*, since all the weight of the refrigerant R-134*a* which discharge the heat in the heat exchanger 2 of the heat source side machine 1 so as to be condensed and to be stored in the liquid phase pipe 6 acts on the heat exchanger 5 of the user side machine 4 mounted on the lower floor as a flowing pressure, the refrigerant R-134*a* is easily supplied. On the contrary, on the heat exchanger 5 of the user side machine 4 mounted on the higher floor, since only the weight of the refrigerant R-134*a* stored in the liquid phase pipe 6 disposed above this portion acts as the flowing pressure, it is hard to supply the refrigerant R-134*a* to the heat exchanger 5 of the user side machine 4 in accordance that the user side machine 4 is mounted on the higher floor. Accordingly, the cooling effect tends to be insufficient.

Accordingly, since in the case that the temperature information detected by the temperature sensors 15 and 16 is the same, when the opening ratio is controlled by outputting the same control signal to the flow control valve 8, a suitable amount of the refrigerant R-134*a* can not supplied in response to the cooling load, the heat source control apparatus 17 is provided with a predetermined control program which outputs a different control signal in correspondence to the floor on which the user side machine 4 is mounted, that is, a program of opening the opening ratio of the flow control valve 8 of the user side machine 4 mounted on the higher floor larger. For example, in the case of the air conditioning system in which the user side machines 4 are separately mounted on ten floors, for example, a correction coefficient of the user side machine 4 mounted on the lowest floor is set to 1, a value adding 0.1 to 1 is set to a correction coefficient of the next higher floor and this manner is continued in the next floors. In this state, at first, the opening ratio of the flow control valve 8 at a time of no correction is given is judged by the normal equation on the basis of the temperature information detected by the temperature sensors 15 and 16. Further, the opening ratio of the flow control valve 8 actually output to the user side machine 4 is judged by multiplying the opening ratio by the desired correction coefficient. The opening ratio of the flow control valve 8 of the user side machine 4 is adjusted to the opening ratio determined in the above manner.

When the heat source control apparatus 17 receives the temperature information detected by the temperature sensors 15 and 16 from the user control apparatus 18 through the communication circuit (not shown), at first, the heat source control apparatus 12 confirms what floor the user side machine 4 sending the signal is mounted, and judges the correction coefficient. Taking the correction coefficient judged by this manner into consideration, the opening ratio of the flow control valve 8 is calculated by the predetermined program, the desired control signal is output to the corresponding user control apparatus 18 through the communication circuit, and the opening ratio of the flow control valve 8 is adjusted to the opening ratio in correspondence to the floor on which the user side machine is mounted. Accordingly, the air conditioning in correspondence to the air conditioning load is performed in each of the user side machines 4.

Then, in each of the user side machines 4, when the cooling load in a certain user side machine 4 is increased (or reduced) and the temperature of the refrigerant R-134*a* detected by the temperature sensor 16 in the user side machine 4 is ascended (or descended), the opening ratio of the corresponding flow control valve 8 is increased (or reduced) by receiving the control signal from the user control apparatus 18 in such a manner as to resolve the temperature ascent (or the temperature descent) and the amount of the refrigerant R-134*a* flowing into the heat exchanger 5 of the user side machine 4 increasing the cooling load is increased (or reduced). Accordingly, the temperature ascent (or descent) of the refrigerant R-134*a* detected by the temperature sensor 16 is resolved before long.

However, when the air conditioning load in an optional user side machine 4 is specially large, the temperature of the refrigerant R-134*a* evaporated from the corresponding heat exchanger 5 and discharged indicates a super-heated state higher than a predetermined temperature, for example, 12° C. for a predetermined period of time, for example, 5 minutes, and the opening ratio of the flow control valve 8 which is controlled on the basis of the temperature information detected by the temperature sensors 15 and 16 becomes already 100%, so that the valve can not opened any more, the heat source side machine 1 is structured such that the temperature of the refrigerant R-134*a* which discharges the heat in the heat exchanger 2 of the heat source side machine 1 so as to be condensed and discharged to the liquid phase pipe 6, which is detected by the temperature sensor 14 provided in the fluid outlet portion of the refrigerant R-134*a* in the heat exchanger 2 indicates, for example, 5° C. in the case that the heat source side machine 1 is controlled in such a manner that the temperature sensor 14 indicates 7° C.

Concretely, in the case that the heat source side machine 1 is constituted by an absorption type refrigerator and the heat exchanger 2 is provided within the evaporator, in accordance with the opening ratio of the fuel control valve 10 on the basis of the control signal output from the heat source control apparatus 17 the fuel control valve 10 is opened so as to increase the calorie applied to the regenerator, the circulating amount of the refrigerator is increased so as to increase the amount of the refrigerant evaporated in the evaporator, and the temperature of the refrigerant R-134*a* which is cooled in the heat exchanger 2 so as to be condensed and discharged from the heat source side machine 1 is reduced at a predetermined temperature.

Further, when the refrigerant R-134*a* having a changed temperature flows into the heat source side machine 1 or the flow amount of the refrigerant R-134*a* flowing into the heat source side machine 1 is changed due to the change of the cooling load, the temperature of the refrigerant R-134*a* detected by the temperature sensor 14 has a change. However, when the cooling load of all the user side machines 4 is greatly changed for a short period of time, the temperature of the refrigerant R-134*a* detected by the temperature sensor 14, which is a target temperature at a time of controlling the opening ratio of the fuel control valve 10 in the heat source control apparatus 17 is changed on the basis of the change of the opening ratio of the flow control valve 8 of the user side machine 4 without waiting for the detection of the temperature change of the refrigerant R-134*a* by the temperature sensor 14.

Namely, when the cooling load is increased during the operation so that the temperature of the refrigerant R-134*a* detected by the temperature sensor 14 is increased, the opening ratio of the flow control valve 8 is increased so as to resolve the temperature increase so that the amount of the refrigerant R-134*a* flowing into the heat exchanger 5 is increased. However, when the opening ratio increasing rate of the flow control valve 8 in all the user side machines 4 becomes, for example, a value equal to or more than 5 to 10%/minute, the target temperature of the refrigerant R-134*a* detected by the temperature sensor 14 is immediately descended in the heat source control apparatus 17, for example, from 7° C. to 5° C., and the opening ratio of the fuel control valve 10 is increased in such a manner that the temperature of the refrigerant R-134*a* detected by the temperature sensor 14 converged into the new target temperature so as to increase the heating power of the burner 11.

Further, when the cooling load is reduced during the operation so that the temperature of the refrigerant R-134*a* detected by the temperature sensor 14 is descended, the opening ratio of the flow control valve 8 is reduced so as to resolve the temperature descent so that the amount of the refrigerant R-134*a* flowing into the heat exchanger 5 is reduced. However, when the opening ratio reducing rate of the flow control valve 8 in all the user side machines 4 becomes, for examples a value equal to or more than 5%/minute, the target temperature of the refrigerant R-134*a* detected by the temperature sensor 14 is immediately ascended in the heat source control apparatus 17, for example, from 7° C. to 9° C., and the opening ratio of the fuel control valve 10 is reduced in such a manner that the temperature of the refrigerant R-134*a* detected by the temperature sensor 14 converged into the new target temperature so as to reduce the heating power of the burner 11.

For example, in the case that the opening ratio of the fuel control valve 10 of the burner 11 is controlled in such a manner that the temperature of the refrigerant R-134*a* detected by the temperature sensor 14 becomes 7° C., when the air conditioning load is suddenly increased, the opening ratio of the fuel control valve 10 is controlled in such a manner that the temperature T becomes, for example, 5° C. for a predetermined period of time, and when the air conditioning load is suddenly reduced, the opening ratio of the fuel control valve 10 is controlled in such a manner that the temperature T becomes 9° C. An embodiment of controlling the above manner at a time of performing the cooling by the heat source control apparatus 17 will be concretely described with reference to FIG. 2.

In a step S1, the total KV of the current opening ratios of the flow control valves 8 in all the operating user side machines 4 is judged, for example, at every 10 seconds.

In a step S2, whether or not the changing amount of the total KV of the opening ratios, that is, the difference ΔKV between the total KV of the current opening ratios and the total KV of the opening ratio 10 seconds before, is equal to or more than, for example, 10% of the total of the full opening ratios of the flow control valve 8 in all the operating user side machines 4 is judged. When the step judges yes, the step goes to a step S3 and when the step judges no, the step goes to a step S4

In the step S3, under the condition of $\Delta T_{tgt}$=−2° C., time counting for a predetermined period of time, for example, 5 to 10 minutes is started. In this case, the starting of the time counting by the timer is operated at a time when the timer does not count time, and when the timer is counting time, the time counting is started after resetting the timer one.

In the step S4, whether or not the ΔKV is less than −10% is judged, and when the step judges yes, the step goes to a step S5, and when the step judges no, the step goes to a step S6.

In the step S5, under the condition of $\Delta T_{tgt}$=+2° C., time counting in the same manner as that in the step S3 is started. In the step S6, whether or not the time counting is going to be performed is judged, and when the step judges yes, the step goes to a step S8, and when the step judges no, the step goes to a step S7.

Then, in the step S7, $\Delta T_{tgt}$=0° C. is set, and in the step S8, the opening ratio of the fuel control valve 10 is controlled on the basis of the temperature T of the refrigerant R-134*a* detected by the temperature sensor 14 and a set temperature $T_{tgt}$ (in this case, 7° C.)+$\Delta T_{tgt}$, for example, by a volume control, and the step goes back to the step S1.

Figure 3:
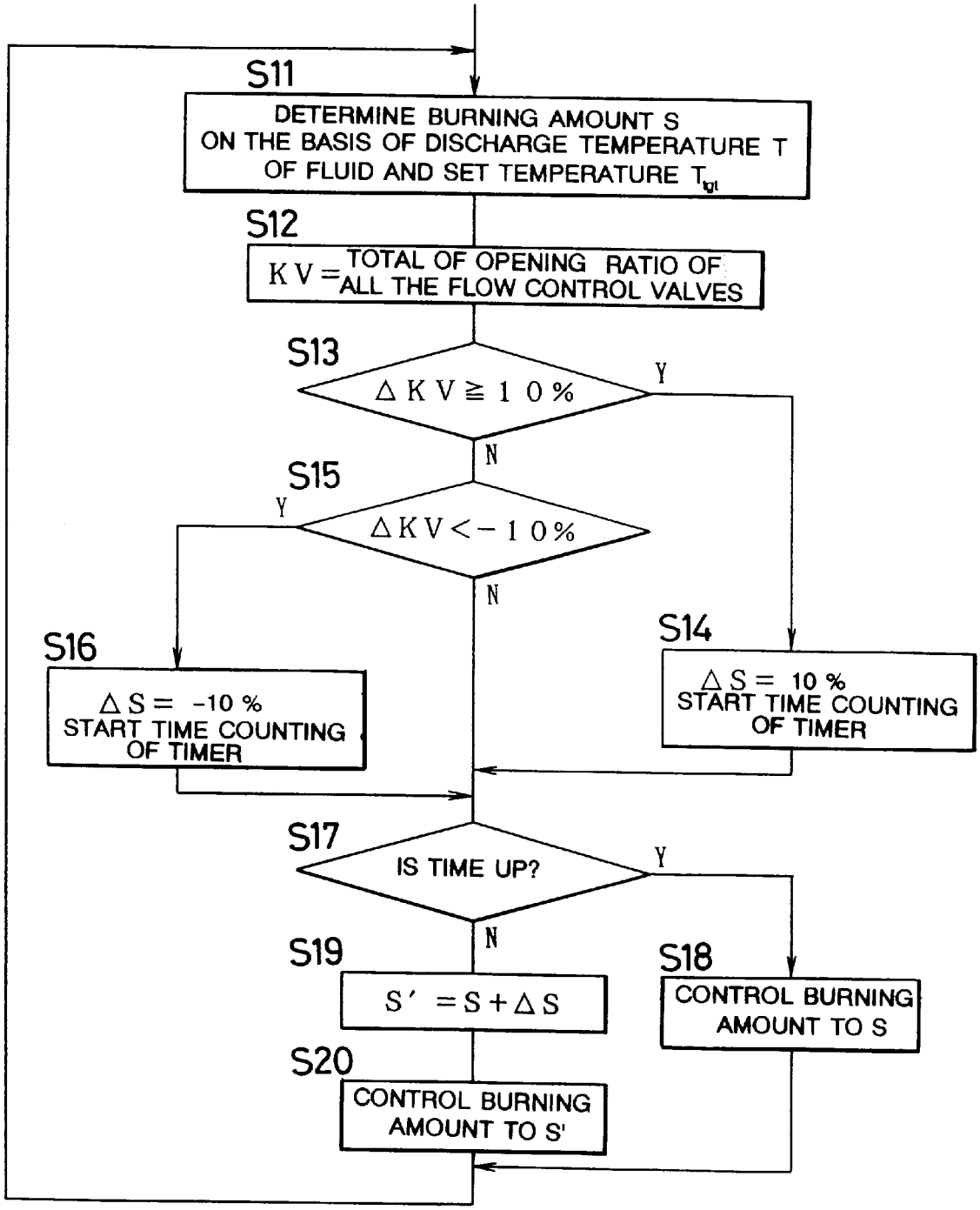
FIG. 3 is a view which explains another embodiment of a control state at a time of performing a cooling.

Further, an embodiment of directly adjusting the burning amount of the burner 11 at a desired time by the heat source control apparatus 17 will be described with reference to FIG. 3. In a step S11, a burning amount S of the burner 11 is judged on the basis of the temperature T of the refrigerant R-134*a* detected by the temperature sensor 14 and the set temperature $T_{tgt}$ (for example, 7° C.).

In a step S12, the total KV of the current opening ratios of the flow control valves 8 in all the operating user side machines 4 is judged, for example, at every 10 seconds, In a step S13, whether or not the changing amount of the total KV of the opening ratios, that is, the difference ΔKV between the total KV of the current opening ratios and the total KV of the opening ratio 10 seconds before, is equal to or more than, for example, 10% of the total of the full opening ratios of the flow control valve 8 in all the operating user side machines 4 is judged. When the step judges yes, the step goes to a step S14 and when the step judges no, the step goes to a step S15.

In the step S14, under the condition, for example, ΔS is set as 10% of the maximum burning in the burner 11, the time counting in the same manner as that in the step S3 is started.

In the step S15, whether or not the ΔKV is less than −10% is judged, and when the step judges yes, the step goes to a step S16, and when the step judges no, the step goes to a step S17.

In the step S16, under the condition, for example, the ΔS is set −10% of the maximum burning in the burner 11, the time counting in the same manner as that of the above manner is started In the step S17, whether or not the time counting is completed is judged, and when the step judges yes, the step goes to a step S18 and returns back to the step S11 after controlling the burning amount of the burner 11 to the value S judged in the step S11.

On the contrary, when the step S17 judges no, the step S19 goes to a step S19 and S'=S+ΔS is set, further the step goes to a step S20 and controls the burning amount of the burner 11 to the value S', then the step goes back to the step S11.

Figure 4:
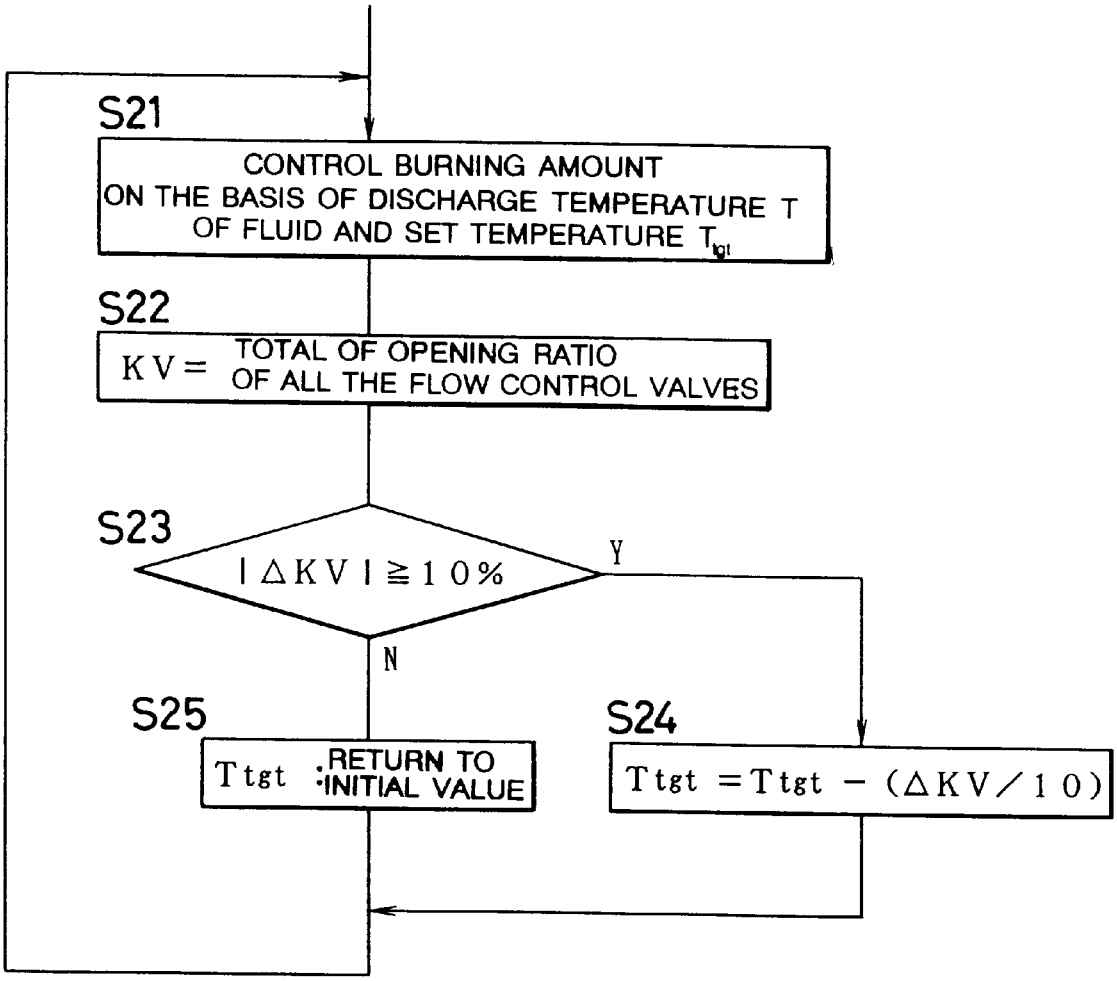
FIG. 4 is a view which explains the other embodiment of a control state at a time of performing a cooling.

Still further, the other embodiment of controlling by the heat source control apparatus 17 will be described below with reference to FIG. 4. In a step S21, the burning amount of the burner 11 is controlled on the basis of the temperature T of the refrigerant R-134*a* detected by the temperature sensor 14 and the set temperature $T_{tgt}$ (for example, an initial value is 7° C.).

In a step S22, the total KV of the current opening ratio of the flow control valve 8 in all the operating user side machines 4 is judged, for example, at every 10 seconds.

Then, in a step S23, whether or not the changing amount of the total RV of the opening ratios (without relation to the direction of the change), that is, the difference ΔKV between the total KV of the current opening ratios and the total KV of the opening ratio 10 seconds before, is equal to or more than, for example, 10% of the total of the full opening ratios of the flow control valve 8 in all the operating user side machines 4 is judged. When the step judges yes, the step goes to a step S24 and when the step judges no, the step goes to a step S25.

In the step S24, for example, $T_{tgt}=T_{tgt}-(\Delta KV/10)$ is set and the step goes back to the step S21, and in the step S25, the value $T_{tgt}$ is returned to the initial value (that is, 7° C.) and the step goes back to the step S21.

As mentioned above, in accordance with the air conditioning system having the above structure of the present invention, in comparison with the conventional control in which the heating power of the burner 11 is controlled by adjusting the opening ratio of the fuel control valve 10 after recognizing that the temperature of the refrigerant R-134*a* detected by the temperature sensor 14, that is, the temperature of the refrigerant R-134*a* which flows into the heat source side machine 1 after the temperature is increased by performing the cooling by the user side machine 4, is cooled in the heat exchanger 2 and is discharged into the liquid phase pipe 6 is widely out of the predetermined temperature 7° C., the opening ratio of the fuel control valve 10, that is, the heating power of the burner 11 immediately follows to the change of the cooling load. Accordingly, quick and stable control of the room temperature can be performed.

In this case, the above control can be performed at a time when the number of the operating user side machines 4 and the circulating speed of the refrigerant R-134*a* are suddenly changed.

In this case, the air conditioning system in accordance with the present invention can be structured such that a receiver tank 20 and an electric pump 21 are provided, as shown in a broken line of FIG. 1.

In this structure, since a transporting force by the electric pump 21 is added to the difference of the specific gravity between the liquid and the gas of the refrigerant R-134*a,* the refrigerant R-134*a* is easily supplied to the heat exchanger 5 of the user side machine 4, so that it is hard that the refrigerant R-134*a* becomes to a super-heat state in the heat exchanger 5. Further, the correction coefficient at a time of determining the opening ratio of the flow control valve 8 can be made small, and the air conditioning system can be constituted by using the flow control valve 8 having a small total capacity. Further, a part of the user side machines 4 can be mounted on the floor higher than or the same as the floor on which the heat source side machine 1 is mounted.

In this case, since the electric pump 21 further secures the circulation of the refrigerant R-134*a* capable of circulating by the difference of the specific gravity between the liquid and the gas, the pump can be significantly made compact in comparison with an electric pump 24 for a heating mentioned below which is required a capacity of transporting the liquid the refrigerant R-134*a* to the heat source side machine 1 mounted on the higher floor. Accordingly, in comparison with the air conditioning system constituted in such a manner that the cooling is performed by using the electric pump 24, even when the cooling is performed by driving the electric pump 17, the electric power consumption is largely reduced Next, an embodiment of the air conditioning system capable of performing a cooling operation and heating operation will be described below with reference to FIG. 5. The heat source side machine 1 in this case comprises an absorption type refrigerator which has a cooling function and a heating function, in which a cooling/heating switching valve 22 (an opening and closing valve) between the cooling and the heating, a receiver tank 23 and the electric pump 24 for the heating are connected to the liquid phase pipe 6 as in a manner shown in the drawing. When the electric pump 24 is stopped with maintaining the use of the cooling function of the heat source side machine 1 and the cooling/heating switching valve 22 is opened, the circulation of the refrigerant R-134*a* mentioned above is generated so that the cooling is performed. When the cooling/heating switching valve 22 is closed with maintaining the use of the heating function of the heat source side machine 1 and the electric pump 24 is driven, the refrigerant R-134*a* in the closed circuit 3 is heated by the heat function of the heat source side machine 1 through the pipe wall of the heat exchanger 2 so as to be evaporated, and is supplied to the heat exchanger 5 of each of the user side machines 4 through the gas phase pipe 7 at a predetermined temperature, for example, 55° C. In each of the heat exchangers 5, the refrigerant R-134*a* discharges the heat to the air within the room having a low temperature which is forcibly supplied by the blower 9 so as to be condensed and liquefied, and the heating is performed at a time when the refrigerant R-134*a* is condensed and liquefied. Further, the liquid of the condensed R-134 is flown into the receiver tank 23 through the flow control valve 8, so that the refrigerant R-134*a* flown into the heat exchanger 2 of the heat source side machine 1 by the transporting force of the electric pump 24 can be circulated, that is, any one of the cooling operation and heating operation can be selected.

In this case, the absorption type refrigerator disclosed in, for example, Japanese Patent Unexamined Publication 7-318189 can be used as the absorption type refrigerator which has a cooling function derived from the heat exchanger 2 provided in the evaporator and also has a heating function.

In each of the user side machines 4, when the heating load in a certain user side machine 4 is increased (or reduced) and the temperature of the refrigerant R-134*a* detected by the temperature sensor 15 in the user side machine 4 is descended (or ascended), the opening ratio of the corresponding flow control valve 8 is increased (or reduced) by receiving the control signal from the user control apparatus 18 in such a manner as to resolve the temperature descent (or the temperature ascent) and the amount of the refrigerant R-134*a* flowing into the heat exchanger 5 of the user side machine 4 increasing the heating load is increased (or reduced). Accordingly, the temperature descent (or ascent) of the refrigerant R-134*a* detected by the temperature sensor 14 is resolved before long.

Further, when the refrigerant R-134*a* having a changed temperature flows into the heat source side machine 1 or the flow amount of the refrigerant R-134*a* flowing into the heat source side machine 1 is changed due to the change of the heating load, the temperature of the refrigerant R-134*a* detected by the temperature sensor 13 has a change. However, when the heating load of all the user side machines 4 is greatly changed for a short period of time, the temperature of the refrigerant R-134*a* detected by the temperature sensor 13, which is a target temperature at a time of controlling the opening ratio of the fuel control valve 10 in the heat source control apparatus 17 is changed on the basis of the change of the opening ratio of the flow control valve 8 of the user side machine 4 without waiting for the detection of the temperature change of the refrigerant R-134*a* by the temperature sensor 13.

Namely, when the heating load is increased during the operation so that the temperature of the refrigerant R-134*a* detected by the temperature sensor 15 is reduced, the opening ratio of the flow control valve 8 is increased so as to resolve the temperature descent so that the amount of the refrigerant R-134*a* flowing into the heat exchanger 5 is increased. However, when the opening ratio increasing rate of the flow control valve 8 in all the user side machines 4 becomes, for example, a value equal to or more than 5 to 10%/minute, the target temperature of the refrigerant R-134*a* detected by the temperature sensor 13 is immediately ascended in the heat source control apparatus 17, for example, from 55° C. to 57° C., and the opening ratio of the fuel control valve 10 is increased in such a manner that the temperature of the refrigerant R-134*a* detected by the temperature sensor 13 converged into the new target temperature so as to increase the heating power of the burner 11.

Further, when the heating load is reduced during the operation so that the temperature of the refrigerant R-134*a* detected by the temperature sensor 15 is increased, the opening ratio of the flow control valve 8 is reduced so as to resolve the temperature ascent so that the amount of the refrigerant R-134*a* flowing into the heat exchanger 5 is reduced. However, when the opening ratio reducing rate of the flow control valve 8 in all the user side machines 4 becomes, for example, a value equal to or more than 5%/minute, the target temperature of the refrigerant R-134*a* detected by the temperature sensor 13 is immediately ascended in the heat source control apparatus 17, for example, from 55° C. to 53° C., and the opening ratio of the fuel control valve 10 is reduced in such a manner that the temperature of the refrigerant R-134*a* detected by the temperature sensor 13 converged into the new target temperature so as to reduce the heating power of the burner 11.

For example, in the case that the opening ratio of the fuel control valve 10 of the burner 11 is controlled in such a manner that the temperature of the refrigerant R-134*a* detected by the temperature sensor 13 becomes 55° C., when the air conditioning load is suddenly increased, the opening ratio of the fuel control valve 10 is controlled in such a manner that the temperature T becomes, for example, 57° C. for a predetermined period of time, and when the air conditioning load is suddenly reduced, the opening ratio of the fuel control valve 10 is controlled in such a manner that the temperature T becomes 53° C. An embodiment of controlling the above manner at a time of performing the heating by the heat source control apparatus 17 will be concretely described with reference to FIG. 6.

In a step S31, the total KV of the current opening ratios of the flow control valves 8 in all the operating user side machines 4 is judged, for example, at every 10 seconds.

In a step S32, whether or not the changing amount of the total KV of the opening ratios, that is, the difference ΔKV between the total KV of the current opening ratios and the total KV of the opening ratio 10 seconds before, is equal to or more than, for example, 10% of the total of the full opening ratios of the flow control valve 8 in all the operating user side machines 4 is judged. When the step judges yes, the step goes to a step S33 and when the step judges no, the step goes to a step S34.

In the step S33, $\Delta T_{tgt}$=+2° C. is set, and the time counting in the same manner as that mentioned above is started. In the step S34, whether or not the ΔKV is less than −10% is judged, and when the step judges yes, the step goes to a step S35, and when the step judges no, the step goes to a step S36.

In the step S35, under the condition of $\Delta T_{tgt}$=−2° C., the time counting in the same manner as that in the step S33 is started. In the step S36, whether or not the time counting is going to be performed is judged, and when the step judges yes, the step goes to a step S38, and when the step judges no, the step goes to a step S37.

Then, in the step S37, $\Delta T_{tgt}$=0° C. is set, and in the step S38, the opening ratio of the fuel control valve 10 is controlled on the basis of the temperature T of the refrigerant R-134*a* detected by the temperature sensor 13 and a set temperature $T_{tgt}$ (in this case, 55° C.)+$\Delta T_{tgt}$, for example, by a volume control, and the step goes back to the step S31.

As mentioned above, in accordance with the air conditioning system having the above structure of the present inventions in comparison with the conventional control in which the heating power of the burner 11 is controlled by adjusting the opening ratio of the fuel control valve 10 after recognizing that the temperature of the refrigerant R-134*a* detected by the temperature sensor 13, that is, the temperature of the refrigerant R-134*a* which flows into the heat source side machine 1 after the temperature is descended by performing the heating by the user side machine 4, is heated in the heat exchanger 2 and is discharged into the gas phase pipe 7 is widely out of the predetermined temperature 55° C., the opening ratio of the fuel control valve 10, that is, the heating power of the burner 11 immediately follows to the change of the cooling load. Accordingly, quick and stable control of the room temperature can be performed Further, the heating operation can be controlled in the same manner as that shown in FIGS. 3 and 4. Further, the above control can be performed at a time when the number of the operating user side machines 4 and the circulating speed of the refrigerant R-134 *a* are suddenly changed, or can be performed in such a manner that the gas pressure of the refrigerant R-134*a* evaporated after heating in the heat exchanger 2 is converged into a predetermined value.

Figure 5:
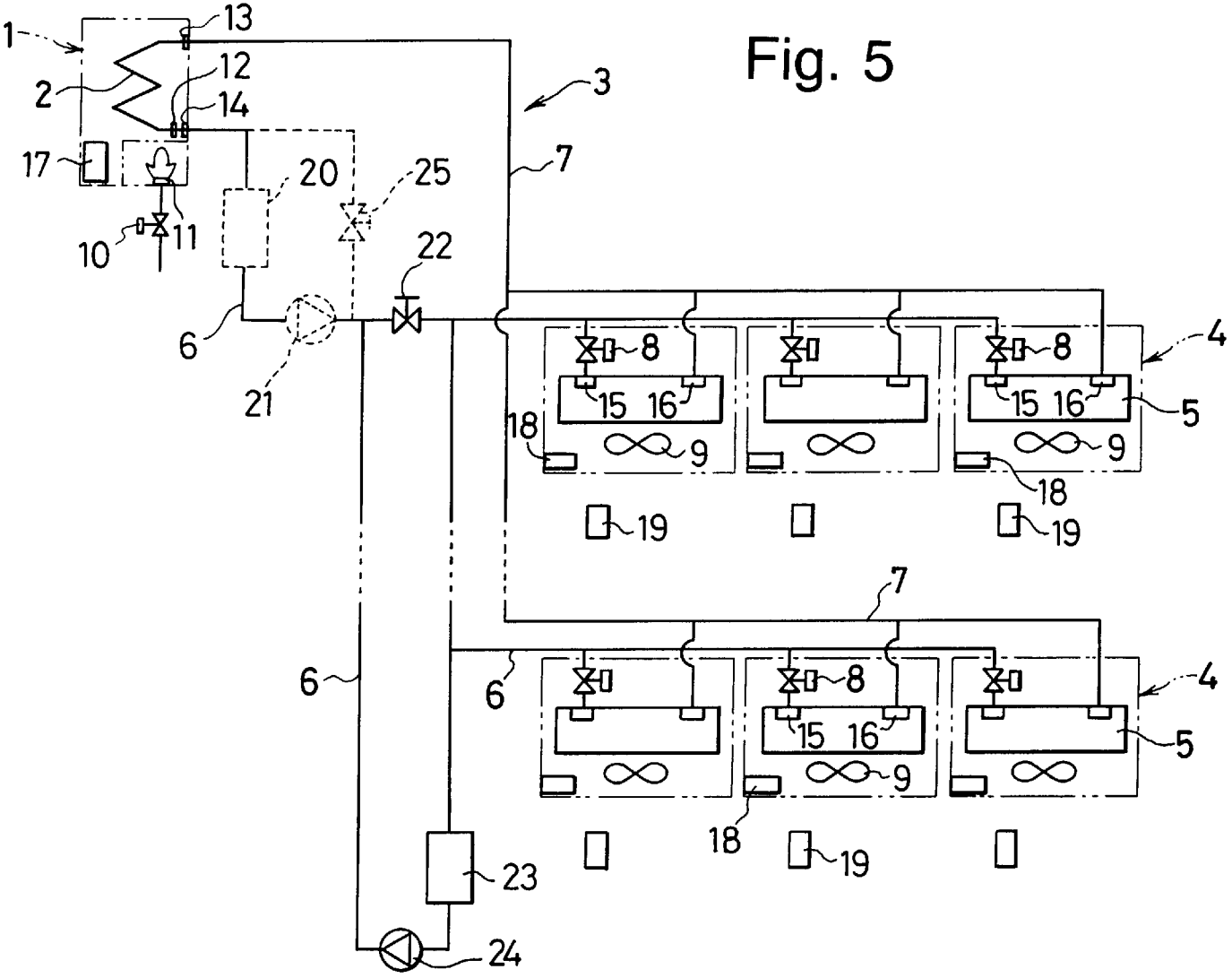
FIG. 5 is a view which explains a structure of an air conditioning system constituted for performing a cooling and heating.
Figure 6:
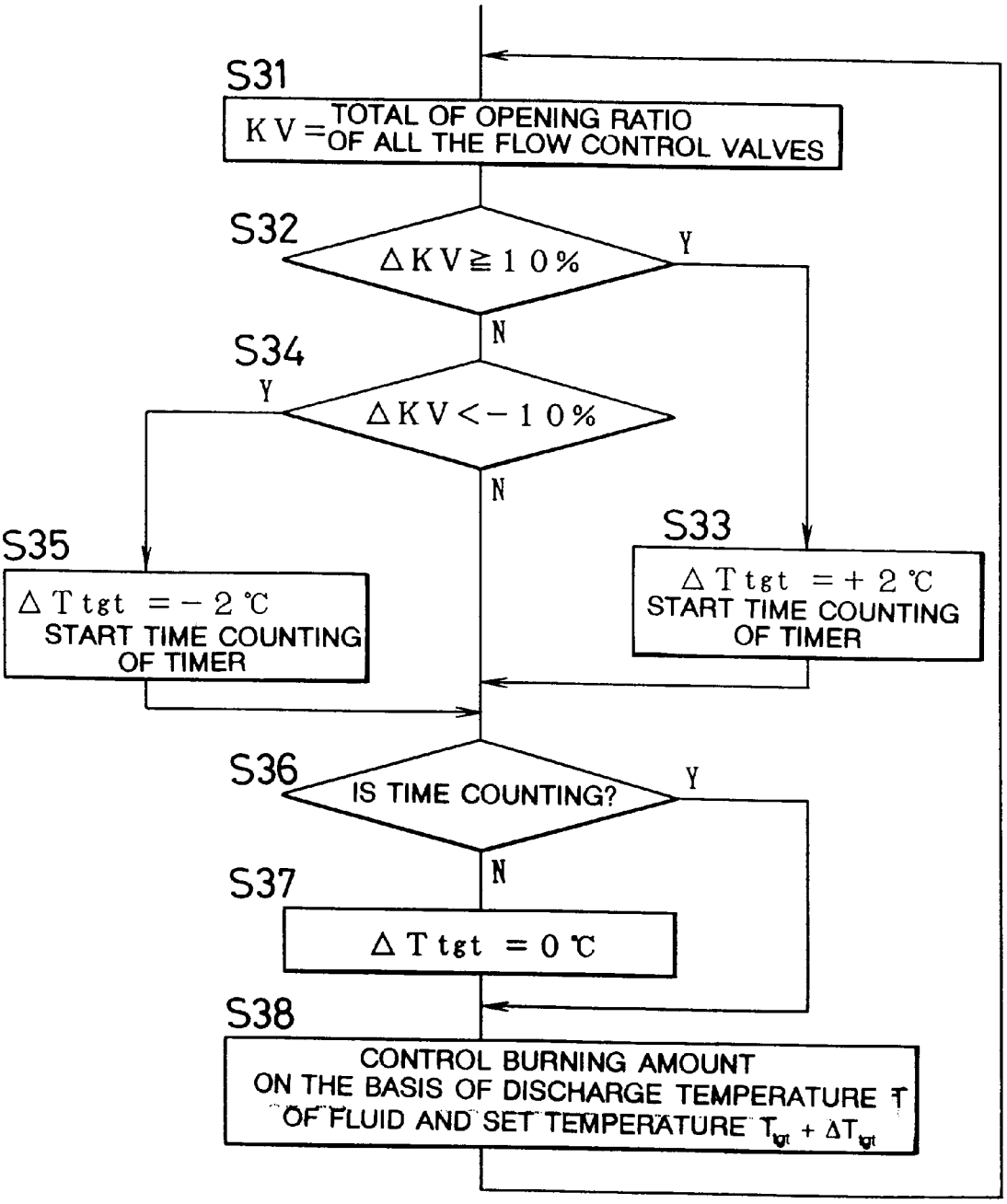
FIGS. 6 is a view which explains a embodiment of a control state at a time of performing a heating.

In this case, in the air conditioning system having the structure shown in FIG. 5, when the receiver tank 20 and the electric pump 21 for performing the cooling operation which are described in FIG. 1 are provided in such a manner as to be shown in a broken lines the same operation and effect can be obtained at a time of performing the cooling.

Further, when the cooling/heating switching valve (the opening and closing valve) 25 shown in the broken line which is opened at a time of performing the heating and closed at a time of performing the cooling is provided, even when the electric pump 21 which is used at a time of performing the cooling is provided, the refrigerant R-134*a* transported toward the heat source side machine 1 by the electric pump 24 for the heating does not pass the electric pump 21 Accordingly, the transporting resistance can be reduced.

Still further, the temperature sensors 15 and 16 can be provided in such a manner as to detect the temperature change of the air within the room to be blown to the heat exchanger 5. A pressure sensor for detecting the pressure difference of the refrigerant R-134*a* in the outlet and inlet portions of the heat exchanger 5 can be provided in place of the temperature sensors 13, 14, 15 and 16, thereby detecting the data for control.

For example, when the air conditioning load is suddenly increased during the cooling, the opening ratio of the fuel control valve 10 can be controlled by the heat source control apparatus 17 in such a manner that the pressure of the refrigerant R-134*a* supplied from the heat source side machine 1 descends.

Further, as the fluid capable of changing the phase and sealed in the closed circuit 3, in addition to the refrigerant R-134*a*, R-407*c*, R-404A, R-410*c* or the like which is easily change the phase by controlling the temperature and the pressure may be employed.

As mentioned above, in accordance with the air conditioning system of the present invention, since the set temperature of the fluid condensed in and discharged from the heat source side machine is descended when the temperature of the fluid evaporated in and discharged from the user side machine at a time of performing the cooling is higher than the predetermined temperature for the predetermined time period, even when the cooling effect is insufficient due to the super-heated state of the fluid in the user side machine, the super-heated state of the fluid is resolved after the predetermined time has passed, thereby returning to the normal cooling.

Further, in the air conditioning system in which the predetermined temperature of the fluid supplied after being controlled to the predetermined temperature in the heat source side machine is adjusted for the predetermined time period when the change of the air conditioning load relating values such as the number of the user side machines and the total of the opening ratio of the flow control valves provided in each of the user side machines becomes over the predetermined value, the air conditioning system can quickly respond to the change of the air conditioning load, so that the temperature in the room is stable.

Further, as shown in the embodiment, in the air conditioning system in which an absorbing cooling and heating apparatus having a cooling function and a heating function by burning the gas or the oil is employed as the heat source side machine, only the electric power for controlling the control devices or driving the auxiliary pump for the cooling operation is used for the electric power at a time of performing the cooling, so that the electric power can be effectively reduced in the summer at which the amount of generating the electric power is maximum.

What is claimed is:

1. An air conditioning system comprising a heat source side machine for condensing a fluid which can change a phase between a liquid phase and a gas phase at a predetermined temperature and for supplying, and a plurality of user side machines more than half of which are disposed below said heat source side machine, in which piping is constructed in such a manner as to circulate the fluid supplied from said heat source side machine by a difference in specific gravity between the liquid phase and the gas phase, between said heat source side machine and said user side machine and a cooling of said user side machine is performed by evaporating said fluid in said user side machine, wherein the heat source side machine is provided with a control means for descending a set temperature of said fluid discharged from said heat source side machine after condensed by changing the operating capacity of said heat source side machine when a state that the temperature of said fluid returned back after evaporated in the user side machine at a time of a cooling is higher than a predetermined temperature continues for a predetermined period of time.

2. An air conditioning system comprising a heat source side machine for controlling a fluid which can change a phase between a liquid phase and a gas phase at a predetermined temperature and for supplying, and a plurality of user side machines more than half of which are disposed below said heat source side machine, in which piping is constructed in such a manner as to circulate the fluid supplied from said heat source side machine, between said heat source side machine and said user side machine and a cooling or heating of said user side machine is performed by evaporating or condensing said fluid in said user side machine, wherein the heat source side machine is provided with a control means for adjusting a predetermined temperature of said fluid for a predetermined period of time when a change of an air conditioning load relating value such as a number of the operating user side machines, a total volume of the fluid flowing in the user side machines or a value corresponding to the total volume, and a total of temperature differences of the fluid flowing in the user side machines is over a predetermined value.

3. An air conditioning system as recited in claim 2, wherein in the case that the change of said air conditioning relating value is a change to a direction that the air conditioning load is reduced, said control means ascends the predetermined temperature of said fluid at a time of the cooling and descends the predetermined temperature of said fluid at a time of the heating, and in the case that the change of said air conditioning relating value is a change to a direction that the air conditioning load is increased, said control means descends the predetermined temperature of said fluid at a time of the cooling and ascends the predetermined temperature of said fluid at a time of the heating.

4. An air conditioning system as recited in claim 3, wherein in the case that the change of said air conditioning relating value is a change to a direction that the air conditioning load is increased, said control means further descends the supplying pressure of said fluid at a time of the cooling.

5. An air conditioning system as recited in claim 3, wherein in the case that the change of said air conditioning relating value is a change to a direction that the air conditioning load is increased, said control means descends the supplying pressure of said fluid in place of the predetermined temperature of said fluid at a time of the cooling.

* * * * *